United States Patent [19]

Terzian et al.

[11] 4,305,222

[45] Dec. 15, 1981

[54] SKATING DOLL

[75] Inventors: Rouben T. Terzian, Chicago; Horst D. Herbstler, Bolingbrook, both of Ill.

[73] Assignee: Marvin Glass & Associates, Chicago, Ill.

[21] Appl. No.: 118,620

[22] Filed: Feb. 4, 1980

[51] Int. Cl.[3] ..... A63H 11/00

[52] U.S. Cl. ..... 46/104; 46/266

[58] Field of Search ..... 46/103, 104, 105, 150, 46/266

[56] References Cited

U.S. PATENT DOCUMENTS

| | | | |
|---|---|---|---|
| 1,150,440 | 8/1915 | Logan | 46/105 |
| 1,261,528 | 4/1918 | Hess | 46/105 |
| 1,550,309 | 8/1925 | Esser | 46/105 |
| 2,243,043 | 5/1941 | Walter | 46/105 |
| 2,378,190 | 6/1945 | Cohen | 46/104 |

FOREIGN PATENT DOCUMENTS

| | | | |
|---|---|---|---|
| 413551 | 7/1946 | Italy | 46/105 |

*Primary Examiner*—F. Barry Shay

*Attorney, Agent, or Firm*—Mason, Kolehmainen, Rathburn & Wyss

[57] ABSTRACT

A roller skating doll includes a pair of roller skates and an internal drive mechanism permitting the doll to skate in a realistic manner. The skates may be removably secured to a pair of legs movably mounted to a torso portion of the body. A pair of arms are operatively associated with the drive mechanism and similarly move in a realistic and natural cyclical path. The head is designed to pivot in accordance with the weight distribution of the body to maintain balance. The drive mechanism includes a plurality of specifically shaped cams to move the legs in a predetermined cyclical path. Each leg is pivoted generally outwardly at the end of its power stroke by a second cam drive mechanism.

13 Claims, 13 Drawing Figures

SKATING DOLL

BACKGROUND OF THE INVENTION

1. Field of the Invention

This invention relates to dolls, and in particular, to a novel doll which is capable of rollerskating.

2. Brief Description of the Prior Art

Many dolls have been devised which attempt to simulate and realistically reproduce many of the actions associated with children. In particular, a few dolls have been designed to provide a self-walking doll capable of traversing a path unassisted by the user for support. In dolls of this type, the actual body or shell is formed by the assembly of two superimposed parts and contains a mechanism adapted to impart an alternate lateral movement to a pair of legs pivotally mounted on the bottom part of the torso. Typical prior art patents include U.S. Pat. Nos. 3,704,543; 3,604,147; 3,596,398; 3,484,988; 3,465,473; 3,445,960; 3,267,608; 3,243,916; and 3,038,275.

SUMMARY OF THE INVENTION

The object of the present invention is to provide a doll which can rollerskate in a lifelike manner.

According to the invention, there is provided a rollerskating doll of the type in which the doll includes a pair of roller skates and an internal drive mechanism permitting the doll to skate in a realistic manner. The skates may be removably secured to a pair of legs movably mounted to a torso portion of the body. A pair of arms are operatively associated with the drive mechanism and similarly move in a realistic and natural cyclical path. The head is designed to pivot in accordance with the weight distribution of the body to maintain balance. The drive mechanism includes a plurality of specifically shaped cams to move the legs in a predetermined cyclical path. Each leg is pivoted generally outwardly at the end of its power stroke by a second cam drive mechanism.

DESCRIPTION OF THE PREFERRED EMBODIMENT

Figure 1:
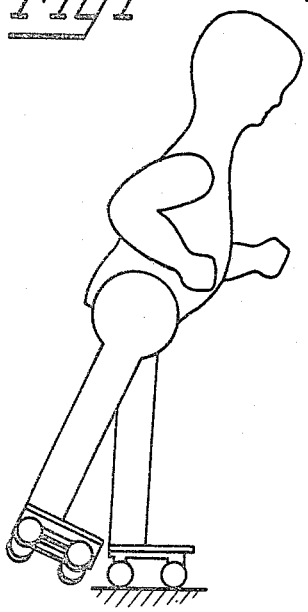
FIG. 1 is a schematic right side perspective view of a rollerskating doll made in accordance with the concepts of the present invention at approximately the end pivot of the right leg power stroke.
Figure 2:
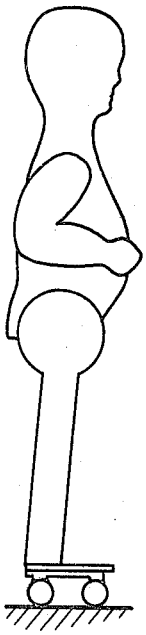
FIG. 2 is a similar schematic perspective view of the rollerskating doll at a dwell point.
Figure 3:
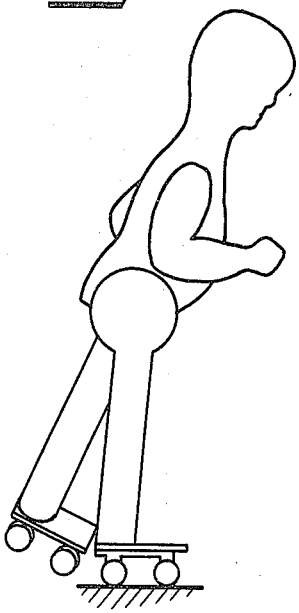
FIG. 3 is another schematic perspective view at approximately the end of the left leg power stroke.

A rollerskating doll made in accordance with the concepts of the present invention is shown in action in FIGS. 1–3 and generally designated by the reference numeral 10. For illustrative purposes, the doll depicted in the drawings and described in the following Specification has been shown as a skeletal figure without the housing portions which form the skin or shell of the torso and extremities. The doll includes a main torso portion 12, a pair of legs 14, a pair of arms 16 and a head 18. A rollerskate 20 is mounted on the bottom of each leg 14 and, for the purposes of the present invention, may be removably mounted to a foot portion 22.

Figure 13:
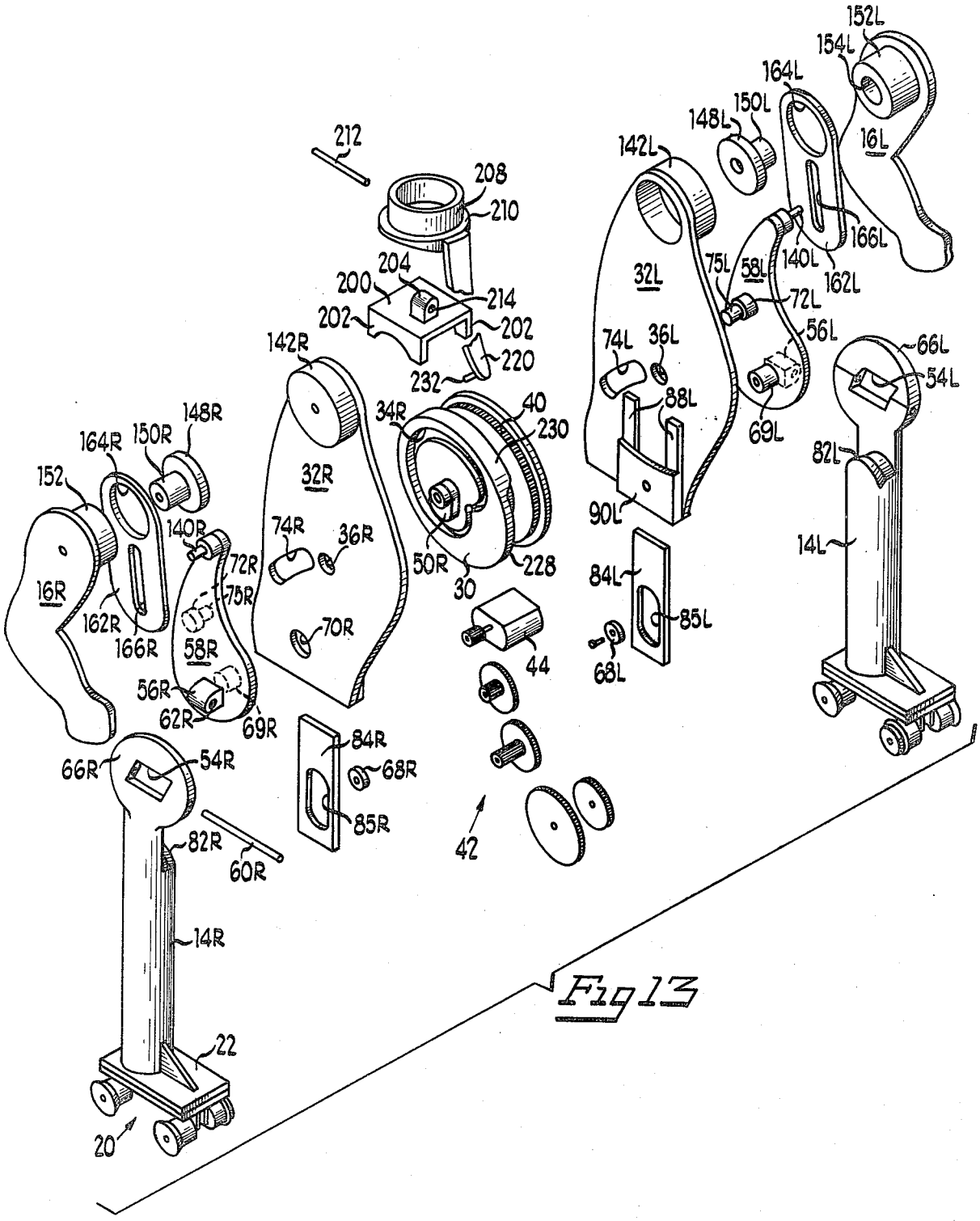
FIG. 13 is an exploded perspective view of the elements of the drive mechanism of the rollerskating doll of the present invention.

The rollerskating doll 10 is capable of providing the various motions as shown in the sequence of FIGS. 1–3 so that it is capable of propelling itself along a generally level supporting surface in a very realistic manner, much as a child or adult rollerskates. A drive means, generally designated 26, is mounted within the torso for moving the legs 14 through their sequential paths. In addition, the drive means 26 is interconnected with the arms 16 to similarly move them in a realistic manner as well as pivoting the head 18 from side to side to assist in maintaining balance. The structural elements and operation of the invention is best described with reference to the exploded view of FIG. 13 in conjunction with the various cross-sectional views.

Figure 10:
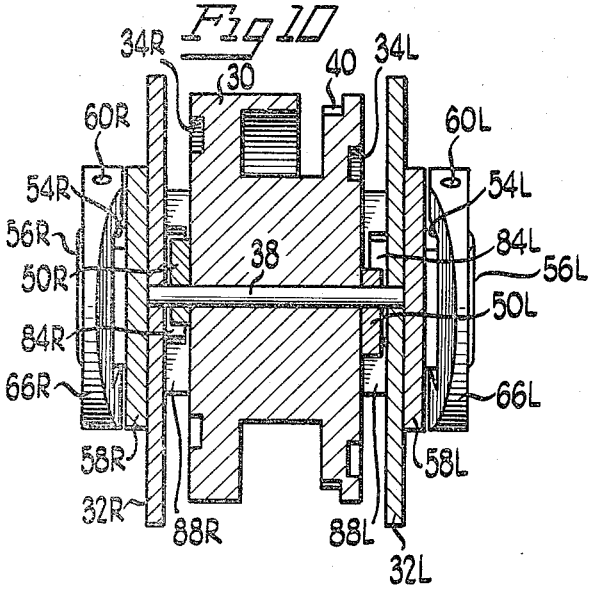
FIG. 10 is another horizontal sectional view taken generally along line 10—10 of FIG. 4.
Figure 11:
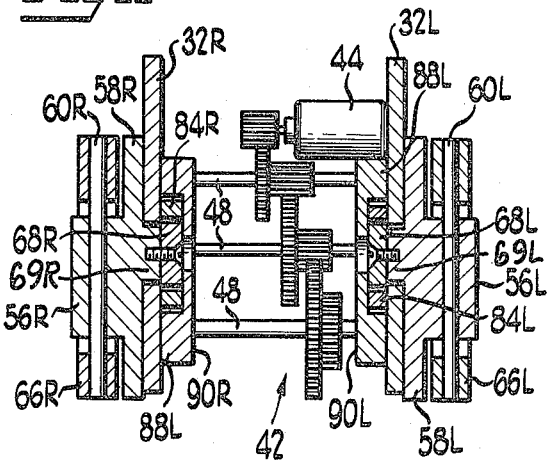
FIG. 11 is another horizontal sectional view taken along line 11—11 of FIG. 4.
Figure 7:
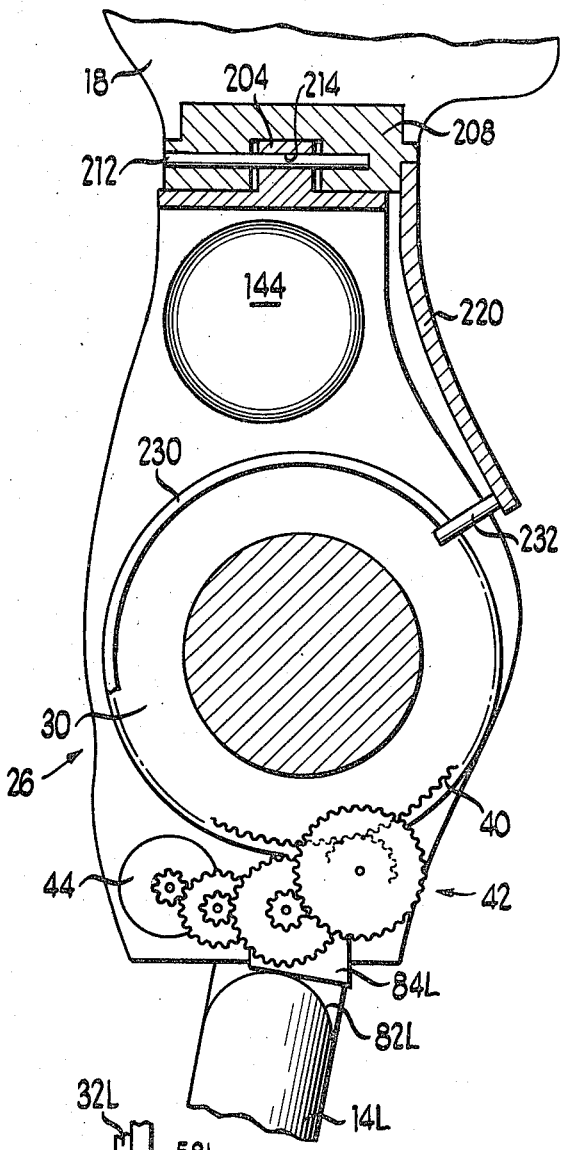
FIG. 7 is a partially fragmented side elevational view of the doll taken generally along line 7—7 of FIG. 4.

The drive means 26 includes a main cam 30 which is rotatably secured between two side torso plates 32. The movable parts of the doll 10 on opposite sides of the center are generally mirror images of one another and therefore the elements on the righthand side will be designated with an "R" while those on the lefthand side will be designated with an "L". The main cam 30 includes two generally heartshaped cam slots 34R and 34L which are 180° out-of-phase. The cam 30 is mounted for rotation within the apertures 36 in the side plates 32 by a horizontal shaft 38, shown in FIG. 10. In the sectional view as shown in FIG. 10, the out-of-phase relationship of the cam slots 34R and 34L can be easily seen. The right side flange of the cam 30 includes a large drive gear 40 which is connected through a gear train 42 to a drive motor 44. As shown in FIGS. 7 and 11, the drive motor 44 is mounted on the inner side of the torso flange 32L and the gears of the gear train 42 are rotatably mounted by the shafts 48 rotatably mounted in apertures provided in the flanges 32 as shown in FIG. 7 so that the overall gear train provides a substantial reduction in the rate of rotation between the motor and the cam 30. Each side of the cam 30 also includes a small lobe 50 adjacent the central aperture which cooperates with the slot 34 to move the respective leg through its motion.

Figure 6:
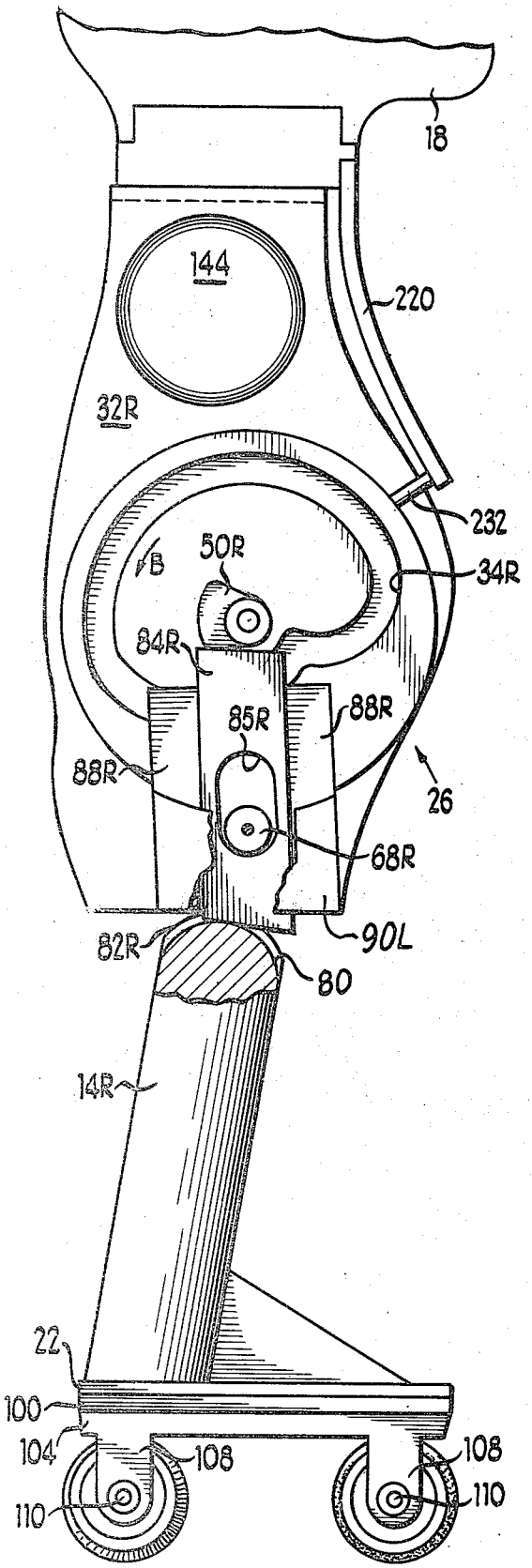
FIG. 6 is a side elevational view of the doll taken generally along line 6—6 of FIG. 4.
Figure 8:
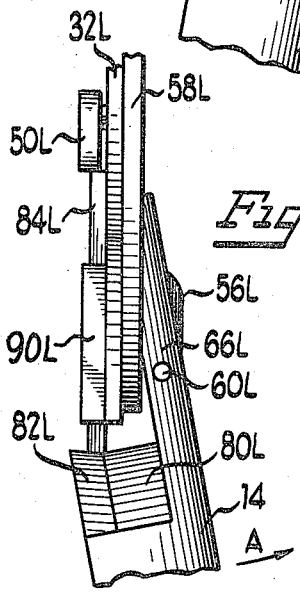
FIG. 8 is a partially fragmented front elevational view, on an enlarged scale, of the left hip joint of the doll.

Each leg 14 is pivotally mounted about two axes. The mounting includes a generally rectangular opening 54 in the top or head portion of the leg which encapsulates a lug 56 on a cam follower 58. Each leg is pivotally secured to its respective lug 56 by a pin 60 which passes longitudinally through the rectangular opening 54 and an aligned aperture 62 in the lug. In addition, the upper end of each leg includes a circular narrowed portion 66 which is narrowed or tapered at its upper end, as shown in FIG. 8, to permit the leg to pivot outwardly as shown by arrow A in FIG. 8 about the pin 60. A journal or axle 69 is mounted on the opposite side of the plate from the lug 56 to pivotally mount the plates 58 in appropriate apertures 70 in the flanges 32. Each of the cam follower plates 58 includes an inwardly directed post 72 which rides within an arcuate slot 74 in the flange 32 and includes a reduced diameter portion 75 which provides a cam follower for sliding within the respective slots 34. Thus, as the main cam 30 is rotated about its axis in a counterclockwise direction as shown by arrow B in FIG. 6, the cam follower plates 58R will rock about their pivot shafts 69 as the posts 72 rock back and forth within the slot 74. As can then be seen, the rocking motion of the cam plate 58 is transmitted through the lug 56 to the respective leg 14.

Figure 5:
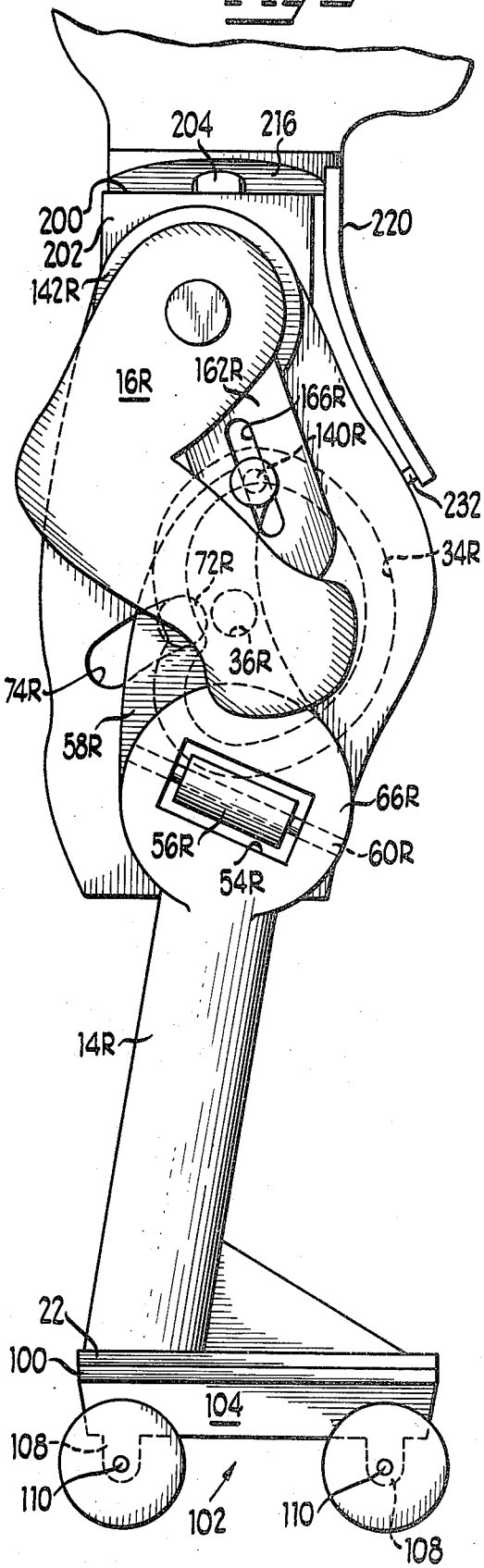
FIG. 5 is a right side elevational view of the doll taken generally along line 5—5 of FIG. 4.

Referring again to FIG. 8, and the cam 30, as each of the legs moves backward during its power stroke, it will pivot outwardly about the pins 60 to lift the rollerskate off of the ground for the return stroke. In particular, each leg 14 includes an upwardly directed arcuate surface 80 adjacent the upper end 66 and a canted arcuate section 82 adjacent thereto. The section 82 provides a cam surface for pivoting the leg outwardly as follows. A vertically reciprocating cam follower 84 is mounted about the pivot post 68 between a pair of upstanding ribs 88 on the inner sides of the side flanges 32. The cam followers 84 are entrapped by a cover plate 90. The posts 68 are secured by small screws on the inner side of the flanges 32 for riding within the slots 85 within the cam followers. The cam followers 84, at their upper end, contact cams 50 so that as the cam engages and moves the cam follower downwardly, shown in its beginning position in FIG. 6 and in its final position in FIG. 8, the cam follower engages the cam surface 82 and pivots the leg outwardly about the pivot pin 60. Thus, the rotation of the cam 30 to the cam follower 75 imparts a rearwardly pivoting action to the leg as the inner cam 50 imparts an outwardly pivoting action to the same leg. FIG. 5 illustrates the position of the cam slot 34 R represented by FIG. 3 with the left leg at its rearwardmost position. In this case, the right leg is in its dwell position when the cam follower is at the innermost point of the arcuate cam slot 34 the leg is at the backmost portion of its stroke. While the leg dwells for approximately 180° of rotation of the cam 30 on the opposite side of the cam slot, the combined rearward pivoting action of the leg with the outward pivoting action at the end of the stroke gives the doll a very realistic and lifelike appearance. It is contemplated that the two sides of the cam 30 as well as the relative positioning of the cams 50 and the cam followers 75 and 84 be adjustable so that final tuning and balancing of the device can be easily accomplished. Generally, according to the above description, the body or torso portion 12 maintains an angle of approximately 15° with the vertical during both the power strokes and any common dwell periods for the legs 14. However, it is equally possible, with proper weight considerations, that the torso remain in an erect position as shown in FIG. 2. Obviously, many minor variations and modifications lying within the spirit and scope of the present invention would be obvious to one skilled in the art.

The rollerskates 20 as shown in the present invention are specifically designed for use with the doll 10 as previously described. In particular, referring to FIGS. 4–6, the rollerskates include an attachment plate 100 which may be permanently affixed to the feet 22, as by glue or the like, or removably secured thereto by an appropriate latch mechanism. The attachment plate includes a truck portion generally designated 102 for mounting the wheels. In particular, the truck includes a downwardly directed U-channel having an outer flange 104 and a slightly smaller inner flange 106. Each of the flanges mounts a pair of depending gears or tabs 108 for rotatably mounting a horizontal axle 110. Each of the axles 110 mounts a pair of wheels on the outer side of the tabs 108. The outermost wheels 112 on each rollerskate are formed with an enlarged diameter flanged portion 114 while each of the inner wheels 116 includes a friction gripping means such as an O-ring 118. The outer flanges 114 are sized according to the O-rings 118 to provide a level rollerskate.

Figure 12:
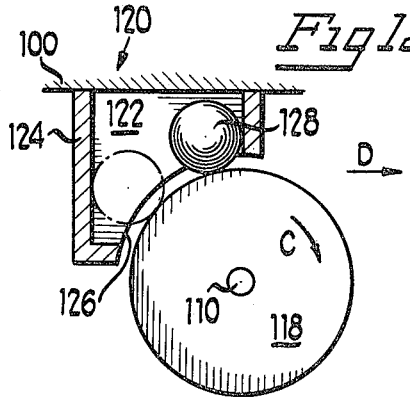
FIG. 12 is a somewhat diagrammatic representation of the ratchet mechanism of the skates.

In order to assist the doll 10 in its skating actions, and because of the fact that there is no knee joint on the legs 14, a ratchet mechanism, generally designated 120, and shown in FIG. 12, enables the wheels 118 to rotate in only one direction. More particularly, the wheel 118 is shown as rotating in a clockwise direction as shown in arrow C when the doll is moving to the right as shown in FIG. 12 by arrow D. The wheel 118 is free to rotate in the clockwise direction but will not rotate in a counterclockwise direction. More specifically, a downwardly extending chamber 122 includes walls 124 having an arcuate cutout 126 adjacent the wheel 118. A ball 128 is mounted within the chamber and is sized such that in its uppermost position, when the wheel is rotated in the direction of arrow C, the ball 128 does not touch the plate 100 and is thus freely rotatable within the chamber 122 and does not affect the rotation of the wheel 118. However, at the beginning of a power stroke for the associated leg 14, the wheel 118 rotates in a counterclockwise direction for approximately 30°, at which time the ball 128 lodges itself against the wall 126 while in engagement with the wheel 118. The pinching effect on the ball will then prevent further counterclockwise rotation of the wheel 118. In this manner, the ratcheted or locked wheel 118 provides a positive point for the driving force of the leg to be applied to the supporting surface.

The foregoing description was concerned mainly with the movement of the legs and the resulting driving force required to propel the doll 10 over a suitable supporting surface. Thereinafter, the description focuses on additional features which provide for realistic movements to further approximate those associated with a rollerskater.

In particular, the arms 16 are caused to move, generally in a timed relationship with the legs as shown in FIGS. 1–3. In the first view, the right arm is retracted with the right leg while in FIG. 3, the right arm is moved forward as the left leg is in its power stroke. The movement of the arms is derived from the same cam drive mechanism which pivots the legs. In particular, referring to FIG. 13, the driving force for each arm 16R or 16L is derived from a pin 140 secured to the upper end of the cam follower plates 58. The upper end of each torso flange 32 carries an outwardly directed cylindrical protrusion 142 which serves as the pivot point for the associated arm and also for encapsulating the battery 144 which supplies power to the motor 44 through small wires (not shown) connected to the contacts 145 at the center of the protrusions 142.

Figure 9:
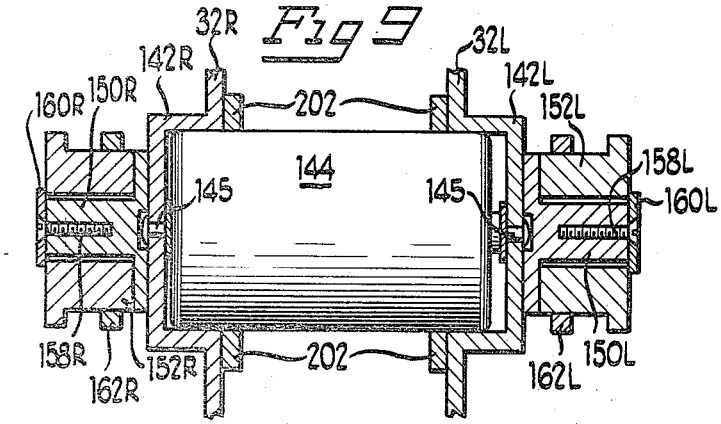
FIG. 9 is a horizontal sectional view through the shoulders, taken generally along line 9—9 of FIG. 4.

A pair of journals 148 are secured to the outer surfaces of the protrusions 142 by glue or other suitable connecting means. Each includes a smaller shaft or journal 150 for supporting an arm. In particular, each of the arms 16 include an inwardly directed annular element 152 which includes a central aperture 154 which rotatably mounts the arm on the journal 150. Referring to FIG. 9, a locking screw 158 includes an enlarged head 160 which prevents the arm from falling off of the journal 150 while permitting relative rotation therewith.

Each arm 16 is drivingly connected to the drive pin 140 on the cam follower plate 58 by a driven plate 162. The drive plates 162 include a top circular aperture 164 which is friction fit over the annular element 152 secured to the arm as shown in FIG. 9. The friction fit between the plate 162 and the annular element 152 enables the arm 16 to preset relative to the plate 162 at any angular orientation. However, after it is preset, by manual movement of the arm, the arm will move as a unit with the plate 162. Each plate 162 carries a lower slot 166 which fits over the pin 140 on the cam follower plate 58 such as shown in the side view of FIG. 5. In this manner, as the cam plate pivots about the pin 68, the pins 140 move in the same direction as the cam followers 75 and their motion is transmitted through the slot 166 to the arms 16. With this mechanism, the arms 16 will move in a timed relationship with the legs to provide for a realistic movement. Because the respective feet 22 are on the opposite sides of the cam follower plate pivot point 68, the arms and legs will generally be moving in opposite directions. However, as described above with respect to the presetting, the arms can be preset in any angular position relative to the body at any time.

Figure 4:
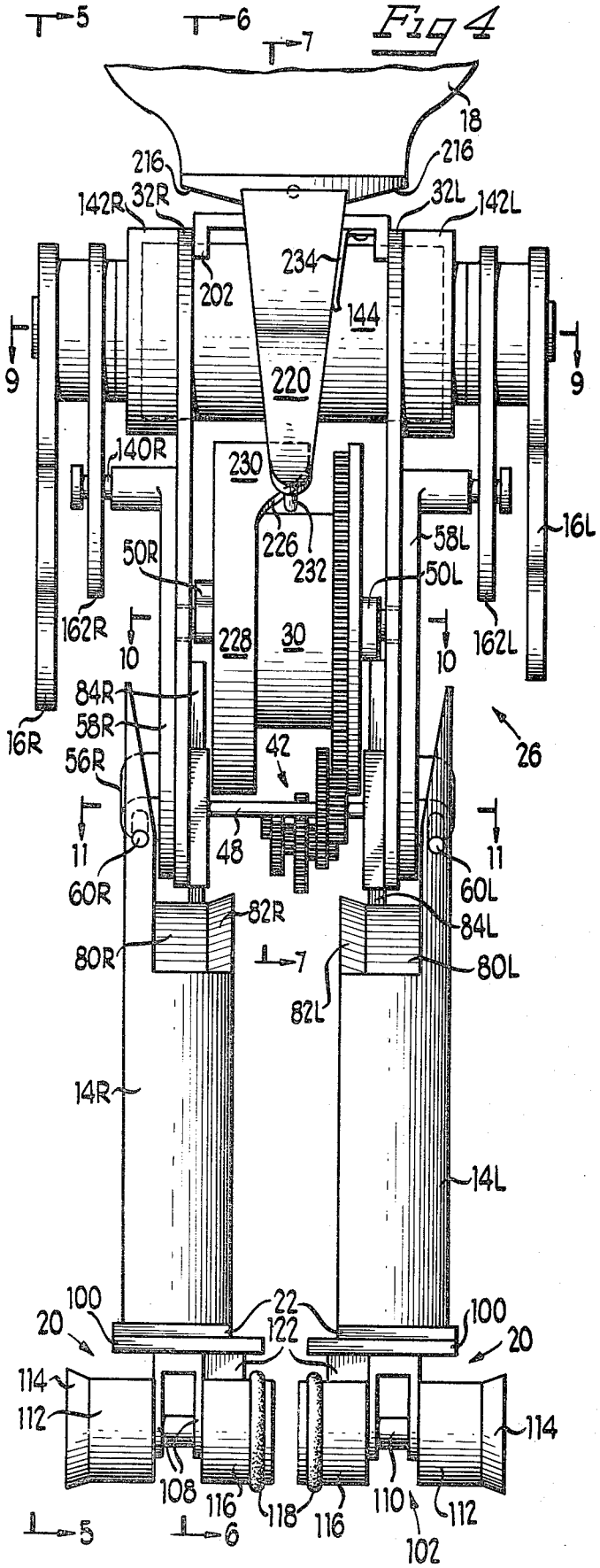
FIG. 4 is a partially fragmented, front elevational view of the doll of FIG. 1 with the outer shell removed showing the driving mechanisms.

Finally, in order to add additional realism, the head 18 is mounted for side to side movement. In particular, a yoke 200 is mounted by a pair of depending flanges 202 about the battery as shown in FIGS. 4 and 9. If desired, the flanges 202 could encircle the battery or merely be secured as by glue to the torso flanges 32. The yoke 200 includes an upstanding tab or ear 204 for mounting the head. The head or shell 18 itself is mounted by its neck portion to an upstanding cylindrical flange 208. The flange includes a bottom extending ring 210 which mounts the head 18 to the ear 204 for pivotal movement by a pin 212. The pin is inserted through an appropriate aperture in the ring 210 through a central aperture 214 in the ear 204. The ring 210 is tapered about its midline as shown by the surfaces 216 in FIG. 4 so that it can pivot slightly to the left and to the right about the pivot pin 212. Finally, in order to drive the head in a timed relationship with the arms and legs, a depending tab 220 extends downwardly toward the cam 30. The cam 30 includes an inner cam surface 226, as shown in FIG. 4, which includes a narrow portion 228 and a larger portion 230 spaced at 180° with one another. The tab 220 includes a pin or cam follower 232 which is biased into engagement with the cam surface 226 by a spring 234. As shown in FIG. 4, the head is essentially vertically oriented since the cam follower 232 is halfway between the cam surfaces 228 and 230. Continued rotation of the cam 30 in the direction of arrow B will cause the head 18 to be pivoted to the left and subsequently, as the larger cam surface 230 is reached, back to the right in a timed relationship with the movement of the legs and the arms.

The foregoing detailed description has been given for clearness of understanding only and no unnecessary limitations should be understood therefrom since many modifications are suggested by the above disclosure and the description therewith and additional modifications would be obvious to those skilled in the art.

We claim:

1. A skating figure, comprising:

a torso;

a pair of legs movably connected to the lower end of said torso;

a pair of wheeled skates, one being mounted on the lower extremity of each leg; and drive means for alternately moving said legs so that each leg, with respect to the other, is moved from a generally vertical orientation to a rear angular position during a power stroke to impart a forward motion to the figure while supported by the skate on the other stationary leg, said drive means including cam means for additionally pivoting each of said legs laterally outwardly of said torso at the end of said power stroke.

2. The skating figure of claim 1 wherein the skates are rollerskates, each having a plurality of wheels rollably mounted thereon for rollingly supporting the figure on a suitable surface.

3. The skaing figure of claim 2 including ratchet means on said skates to permit relative movement between the skate and the supporting surface in only one direction.

4. The skating figure of claim 1 including a pair of arms pivotally mounted on the upper end of the torso.

5. The skating figure of claim 4 including connection means between the arms and the drive means to impart alternate angular displacement of the arms in synchronism with the movement of the legs.

6. The skating figure of claim 1 including means for balancing the figure as it is alternately supported on its opposite legs.

7. The skating figure of claim 4 including means for balancing the figure as it is alternately supported on its legs.

8. A roller skating doll, comprising:

a torso;

a pair of arms, a pair of legs, and a head pivotally mounted to said torso;

a pair of wheeled skates, one mounted to the bottom of each leg; and drive means connected to said arms, legs and head for alternately pivoting the legs so that each leg, with respect to the other, is moved through a predetermined angular displacement to drive the doll forwardly while supported on the other leg, moving the arms in an alternate angular displacement in synchronism with the legs, pivoting the head to maintain balance and propelling the doll over a suitable supporting surface in a realistic skating manner, said drive means including cam means for additionally pivoting each of said legs laterally outwardly of the torso at the end of said angular displacement of said leg.

9. The rollerskating doll of claim 8 wherein the skates are rollerskates, each having a plurality of wheels rollably mounted thereon for rollingly supporting the figure on a suitable surface.

10. The rollerskating doll of claim 8 or 9 wherein said drive means includes a motor gearingly connected to a main cam and cam follower means between the cam and the arms, legs and head for moving the same in their predetermined manner.

11. The rollerskating doll of claim 10 wherein the head is moved by a single lobed cam having a right side portion and a left side portion extending through an angle of approximately 180° of the cam.

12. The rollerskating doll of claim 11 including spring biasing means for maintaining said head cam follower in contact with said cam.

13. The rollerskating doll of claim 10 wherein said main cam includes a pair of generally heart-shaped slots and the cam follower includes a post riding in said slot, said cam follower being connected to the arm and leg on one side of the doll.

* * * * *